United States Patent [19]

Lonati

[11] Patent Number: 4,718,256

[45] Date of Patent: Jan. 12, 1988

[54] KNITTING MACHINE OR THE LIKE WITH A DEVICE FOR RAISING AND LOWERING THE PLATEN

[75] Inventor: Francesco Lonati, Brescia, Italy

[73] Assignee: LONATI S.p.A., Brescia, Italy

[21] Appl. No.: 916,903

[22] Filed: Oct. 7, 1986

[30] Foreign Application Priority Data

Oct. 14, 1985 [IT] Italy ..... 22466 A/85

[51] Int. Cl.[4] ..... D04B 15/18

[52] U.S. Cl. ..... 66/95; 66/145 R

[58] Field of Search ..... 66/27, 28, 95, 145 R

[56] References Cited

U.S. PATENT DOCUMENTS

| | | | |
|---|---|---|---|
| 1,253,563 | 1/1918 | Ballard | 66/28 |
| 1,461,693 | 7/1923 | Bromley et al. | 66/28 |
| 1,639,522 | 8/1927 | Madaris | 66/28 X |
| 1,745,678 | 2/1930 | Howie | 66/28 X |
| 3,757,538 | 9/1973 | Martinetz | 66/28 X |
| 4,120,045 | 10/1978 | Moellgaard et al. | 66/232 X |

FOREIGN PATENT DOCUMENTS

| | | | |
|---|---|---|---|
| 2611668 | 10/1976 | Fed. Rep. of Germany | 66/27 |

*Primary Examiner*—Wm. Carter Reynolds

*Attorney, Agent, or Firm*—Guido Modiano; Albert Josif

[57] ABSTRACT

The knitting machine has a device for raising and lowering the platen, which comprises a frame, associated with the supporting structure of the machine, which supports the platen above the needle-bearing cylinder. The machine also comprises at least one guiding column for sliding said frame with respect to the supporting structure of the machine along a direction parallel to the axis of the needle-bearing cylinder and a step motor which is connected to an electronic member for controlling the machine and which acts on moving means connected to said frame and to the supporting structure to perform the above described sliding according to a preset program.

3 Claims, 2 Drawing Figures

KNITTING MACHINE OR THE LIKE WITH A DEVICE FOR RAISING AND LOWERING THE PLATEN

BACKGROUND OF THE INVENTION

The present invention relates to a knitting machine or the like with a device for raising and lowering the platen.

Knitting machines, particularly stocking -making machines, are known with devices for raising or lowering the platen. These devices comprise a system of levers which act on a frame which supports the platen above the needle-bearing cylinder and is associated with the supporting structure of the machine with the possibility of sliding along a direction which is parallel to the axis of the needle-bearing cylinder. The system of levers is connected to a cam-bearing cylinder which controls the various operations of the machine and intervenes on the levers, giving rise to the raising or lowering of the platen according to the requirements of the process in progress.

Usually, controlled raising or lowering are required during the formation of the edge of the stocking, when the hooks carried by the platen are conveyed externally to engage and withhold the loops formed by the needles of the cylinder; or a lowering is required when the thread pinching device, carried by the platen, must hook a new thread for the changing of the thread-holder.

A raising of the platen is furthermore required every time it is necessary to inspect the interior of the needlebearing cylinder wherein the descent of the stocking occurs during the formation thereof.

Such known kinds of machines, though they obtain the lowering of the platen according to the procesing requirements, have some disadvantages.

The most important of these disadvantages are related to the lever system which connects the cam-bearing cylinder, which controls the various processing phases, to the platen. The presence of these levers, in fact, constitutes a significant bulk, which contributes towards increasing the overall dimensions of the machine and hinders maintenance interventions in the areas proximate thereto.

Another disadvantage is due to the fact that these levers require accurate calibration during the setup of the machine, as well as periodic servicing to recover the play which unavoidably occurs due to machine wear.

SUMMARY OF THE INVENTION

The main aim of the present invention is therefore to eliminate the above described disadvantages by providing a knitting machine with a device for raising and lowering the platen which can operate without implying complex and cumbersome lever systems.

Within the scope of the above described aim, an object of the invention is to provide a device which achieves the raising of the platen, according to the requirements of the processing, by the action of an electronic control member which supervises the various operations of the machine.

Another object of the invention is to reduce the time required for setting up the machine and to limit maintenance interventions.

The aim and the objects described, as well as others which will become apparent hereinafter, are achieved by a knitting machine or the like with a device for raising and lowering the platen, which comprises a frame, associated with the supporting structure of the machine, which supports the platen above the needle-bearing cylinder, characterized in that is comprises: guiding means for sliding said frame with respect to said supporting structure parallel to the axis of said needle-bearing cylinder and a step motor which is connected to an electronic apparatus for controlling the machine and which acts on moving means connected to said frame and to said supporting structure to perform the above described sliding according to a preset program.

BRIEF DESCRIPTION OF THE DRAWINGS

Further characteristics and advantages of the invention will become apparent from the description of a particular, but not exclusive, embodiment of the machine, illustrated by way of non-limitative example of the accompanying drawings, where.

DESCRIPTION OF THE PREFERRED EMBODIMENTS

Figure 1:
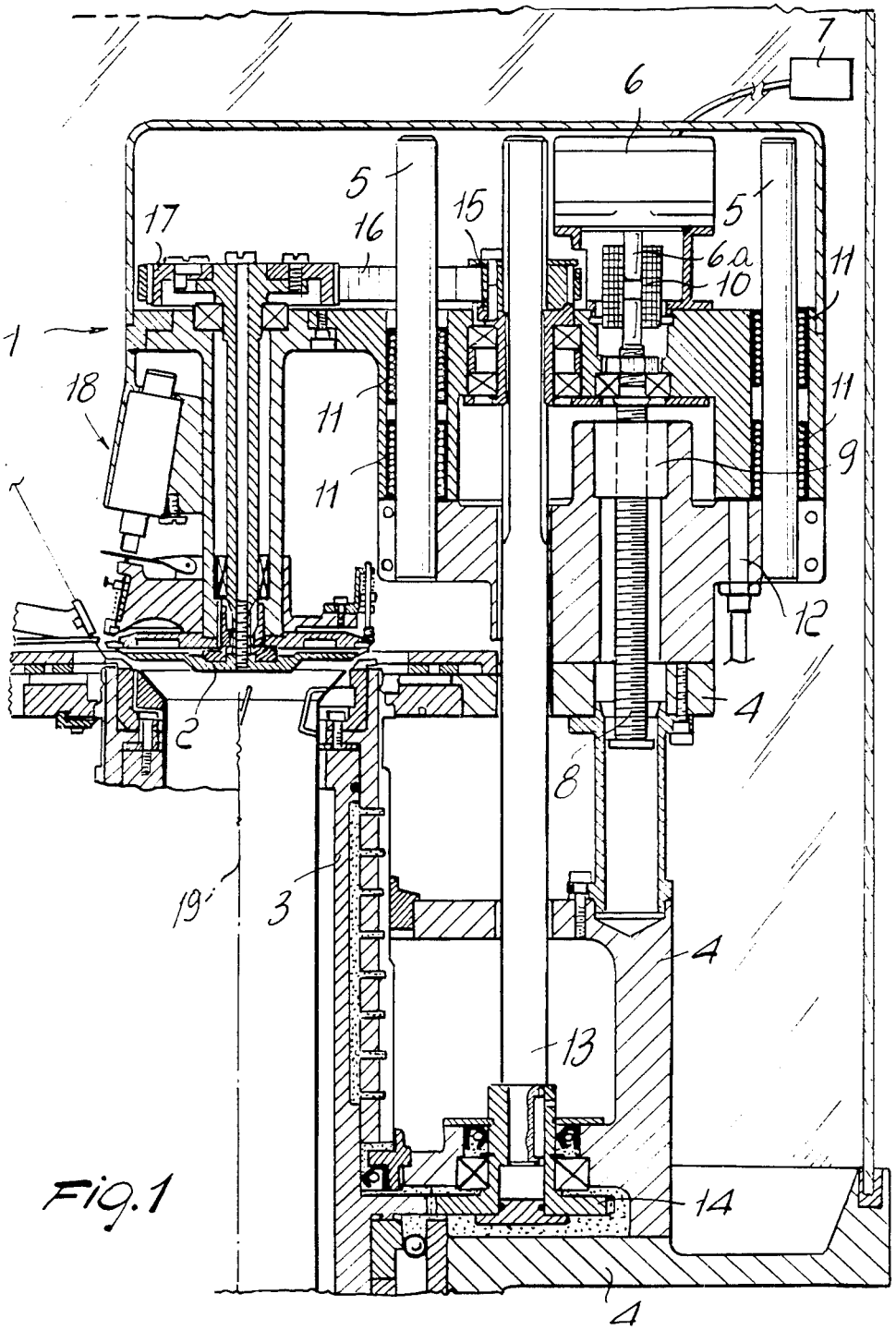
FIG. 1 is a cross section view of the top part of the machine according to the invention, as taken on a plane traversing the axis of the needle-bearing cylinder, with the platen in lowered position.
Figure 2:
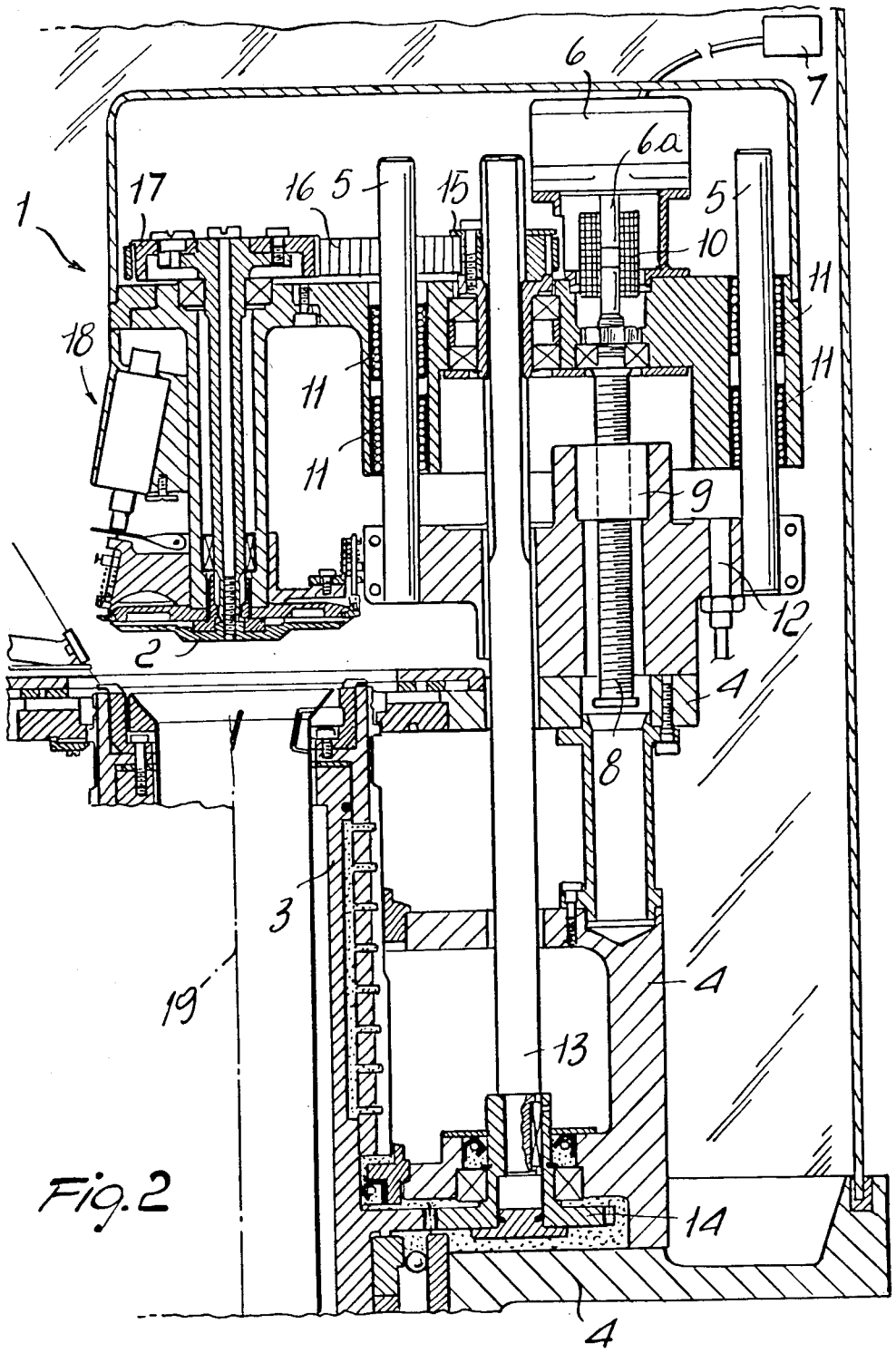
FIG. 2 is a cross section view of the top part of the machine according to the invention, similar to the view of FIG. 1, with the platen in the fully raised position.

With reference to the above described figures, the machine according to the invention, in the case shown a stocking-making machine, comprises a frame 1 which supports rotatably the platen 2 above the needle-bearing cylinder 3.

The frame 1 is supported movably by the supporting structure 4 of the machine and means are provided for guiding, composed of at least one column 5, in the case shown there being two columns extending parallel to the axis 19 of the needle-bearing cylinder, traversing the frame 1 and fixed to the supporting structure 4. In this manner the frame 1, and therefore the platen, can move parallel to the axis of the needle-bearing cylinder to raise or lower itself.

According to the invention, the machine comprises a step motor 6 which is supported by the frame 1 and which is connected to an electronic control member 7, e.g. a microprocessor. The step motor acts on moving means to provide the sliding of the frame 1 with respect to the supporting structure 4.

The moving means are composed of a threaded shaft 8, rotatably supported by the frame 1, which is prevented from moving along its axis and is engaged with a female thread 9 rigidly coupled with the supporting structure of the machine. The threaded shaft 8, which is parallel to the columns 5, is associated coaxially with the output shaft *6a* of the step motor, so that a rotation of the output shaft *6a*, imparted by the control member, gives rise to a motion of the frame with respect to the supporting structure, in a direction extending parallel to the axis 19 of the needle cylinder.

To avoid vibrations, it is possible to connect the output shaft *6a* of the step motor to the threaded shaft, by interposing an elastic joint 10.

Furthermore, in order to keep the dimensions of the step motor small, is it possible to provide anti-friction means 11 between the columns 5 and the frame 1, e.g. a ball-screw or bearing screw.

The machine also comprises safety means, essentially composed of a detector 12 of the distance between the frame 1 and the supporting structure 4, connected to the control apparatus 7 of the machine, which prevents the actuation of the step motor when the machine is in a processing phase wherein the platen must not be raised, such as, e.g., after the hooks of the platen have engaged the loops of the needles of the cylinder during the forming of the edge of the stocking.

A service electric circuit can be furthermore provided, which, when the machine is stopped, actuates the step motor upon command, to obtain the raising of the frame 1 to inspect the interior of the needle-bearing cylinder.

For the sake of completeness of description, it should be noted that the frame 1 also houses elements for transmitting rotating motion from the needle-bearing cylinder to the platen.

More particularly, a transmission shaft 13 is provided, which is connected, by virture of a toothed wheel 14, to the needle-bearing cylinder, and which, in the frame 1, slideably carries a driving pulley 15 connected by means of a toothed belt 16 to a driven pulley 17 which actuates the platen.

The frame 1 can furthermore support, as usually occurs in these machines, other kinds of devices, such as e.g. a device for pinching the thread 18.

Naturally, in the embodiment described the step motor has been fixed on the frame 1, but in a fully similar manner it could be fixed to the supporting structure of the machine, by providing the female thread 9 rigidly coupled with the frame 1 and the threaded shaft 8 supported rotatably by the supporting structure 4.

After what has been described, the operation of the machine, as far as the raising and the lowering of the platen with respect to the needle-bearing cylinder is concerned, is clear.

According to the operative requirements, the electronic control apparatus 7, by following a preset program, can intervene to actuate the step motor 6.

When the step motor is actuated, the rotation, according to a preset angle, of the output shaft 6*a* gives rise to a rotation of the threaded shaft 8, which is engaged with the female thread 9. By virtue of this rotation, there occurs a motion by a preset amount of the frame 1, and therefore of the platen 2, which rises and lowers according to the direction of rotation of the output shaft.

If it is desired to inspect the interior of the needle-bearing cylinder, it is possible to obtain the raising of the platen by employing the electric service curcuit.

An unwanted raising of the platen during a machine processing phase wherein the electronic control apparatus imposes a blocking of the platen is prevented by the action of the detector 12.

In practice, it has been observed that the machine with a device for raising and lowering the platen according to the invention fully achieves the intended aim, in that it has reduced dimensions and does not require complex lever systems.

A further advantage is that of being capable of connecting more that one machine to a single central electronic control unit in the case of large-scale production.

The machine thus conceived is susceptible of numerous modifications and variations, all of which are within the scope of the inventive concept; furthermore, all the details can be replaced by technically equivalent elements.

In practice, any materials and dimensions, may be employed according to the requirements and to the state of the art.

I claim:

1. Knitting machine or the like, with a device for raising and lowering the platen, comprising a frame, associated with the supporting structure of the machine, which supports the platen above the needle-bearing cylinder, guiding means for sliding said frame with respect to said supporting structure parallel to the axis of said needle-bearing cylinder a step motor which is connected to an electronic member for controlling the machine and which acts on moving means connected to said frame and to said supporting structure to perform the above described sliding according to a preset program, said moving means being in the form of a threaded shaft, rotatably supported by said frame and associated coaxially with the output shaft of said step motor, said threaded shaft being arranged parallel to the axis of said needle-bearing cylinder.

2. Knitting machine according to claim 1 characterized in that said threaded shaft is associated with the output shaft of said step motor with the interposition of an elastic joint.

3. Knitting machine according to claim 1 characterized in that it comprises safety means placed between said frame and said supporting structure for blocking upon command said sliding, said safety means being connected to said electronic control member.

* * * * *